US005263350A

United States Patent [19]

Crippa

[11] Patent Number: 5,263,350

[45] Date of Patent: Nov. 23, 1993

[54] MULTI-FUNCTION PIPE BENDING MACHINE

[75] Inventor: Antioni Crippa, Arosio, Italy

[73] Assignee: Fabbrica Macchine Curvatubi Crippa Agostini S.P.A., Italy

[21] Appl. No.: 960,009

[22] Filed: Oct. 13, 1992

[30] Foreign Application Priority Data

Oct. 16, 1991 [IT] Italy ..... MI91 A 002737

[51] Int. Cl.[5] ..... B21D 7/04

[52] U.S. Cl. ..... 72/157; 72/155

[58] Field of Search ..... 72/157, 158, 155, 153, 72/154, 156, 149

[56] References Cited

U.S. PATENT DOCUMENTS

| | | | |
|---|---|---|---|
| 3,147,792 | 9/1964 | Hautau | 72/157 |
| 3,299,681 | 1/1967 | Hautau | 72/155 |
| 4,112,728 | 9/1978 | Noack et al. | 72/155 |
| 4,495,788 | 1/1985 | Traub | 72/157 |
| 4,727,738 | 3/1988 | Yogo | 72/157 |
| 4,941,338 | 7/1990 | Späth | 72/155 |
| 5,010,758 | 4/1991 | Togoshi | 72/157 |
| 5,042,279 | 8/1991 | Togoshi | 72/157 |

FOREIGN PATENT DOCUMENTS

| | | | |
|---|---|---|---|
| 0259836 | 11/1986 | Japan | 72/157 |
| 2187666 | 9/1987 | United Kingdom | 72/157 |

*Primary Examiner*—Lowell A. Larson
*Assistant Examiner*—Michael J. McKeon
*Attorney, Agent, or Firm*—Laff, Whitesel, Conte & Saret

[57] ABSTRACT

A multi-function pipe bending machine (1) comprising a base structure (2), a first slide (8) slidably engaged to the base structure (2) along a first traverse direction, a second slide (11) slidably engaged to the first slide (8) along a second traverse direction perpendicular to the first direction, a first and a second bending die (14*a*, 14*b*), at least one unit (15*a*, 15*b*) for positioning and locking a pipe (6) to be bent, and a bending arm (18) active on the pipe (6) against the action of the bending dies (14*a*, 14*b*).

4 Claims, 3 Drawing Sheets

MULTI-FUNCTION PIPE BENDING MACHINE

BACKGROUND OF THE INVENTION

1. Field of the Invention

The present invention relates to a multi-function pipe bending machine.

It is known that in many types of applications the formation along the same pipe of several bendings which are close to each other and oriented in opposite directions is often required, which means that it is for example necessary first to execute a bending to the right in a pipe length, and then a bending to the left in another length of the same pipe, the second bending being close to the first one.

In other cases bendings in succession are to be carried out in separate planes, for example in planes perpendicular to each other.

2. Prior Art

In the known art, such bendings are achieved through the sequential use of one pipe bending machine for carrying out the bending to the right for example, and a second pipe bending machine for executing the left bending.

In fact, if one would try to use the same machine for carrying out a bending in the opposite way with respect to the one provided by the machine, once the first bending has been executed he would be obliged to rotate the pipe. But this operation will be generally impossible when bendings are very close to each other because the pipe portion that has been already bent would interfere with the bending head. It is therefore absolutely necessary to remove the pipe from the first pipe bending machine, carry it to the second pipe bending machine and make all operations necessary for placement and mounting of the pipe to the second machine.

The operating steps briefly described above involve important downtime and production slowing down that give rise to an increase in the production costs when several bendings in opposite ways are necessary.

Attempts have been made to solve the above drawbacks by using bending heads equipped with a dual locking arrangement available at two positions rotated through 180° from each other so that the bending to the right could be first carried out and subsequently the bending to the left. However these attempts have not been successful too, because in this solution important downtime periods during which the production operations are stopped are required for disassembling the head and carrying out its rotation.

In addition pipe bending machines of known type often do not allow the bending dies, that is the shaped components to which the pipe is forcedly made to adhere so that it may be suitably bent, to be easily replaced. In fact it is necessary to completely remove the pipe, replace the die and set the pipe in place again.

In addition, often a reduced range of different dies can be used on a single machine because the distance between the positioning axis of the pipe and the engagement pin of the die is fixed. As a consequence, for a given outer diameter of the pipe, there is only one bending radius in each machine according to which the same pipe can be bent.

SUMMARY OF THE INVENTION

Under this situation, the technical task underlying the present invention is to devise a multi-function pipe bending machine capable of substantially eliminating the above drawbacks.

Within the scope of this technical task it is an important object of the invention to devise a multi-function pipe bending machine enabling bendings of pipes oriented in opposite ways and lying in different planes to be easily and readily carried out.

Another important object of the invention is to provide a pipe bending machine enabling a wide variety of bending dies to be used so that bendings even of different radii along one and the same pipe can be easily and readily made.

A further object of the invention is to devise a pipe bending machine enabling a self-governing and automatic loading of the pipes without resorting to external manual interventions or to automatic handlers (robots).

The technical task mentioned and the objects specified are substantially attained by a multi-function pipe bending machine comprising:

a base structure, at least one bending die, at least one unit for positioning and locking a pipe to be bent against said bending die, a rotatably movable bending device active on said pipe against the action of said die, further comprising:

one support body slidably engaged to said base structure along one traverse direction, first actuation means for displacing said first support body, a second support body slidably engaged to said first body along a traverse direction perpendicular to said first traverse direction, and second actuation means for displacing said second support body, said bending die, positioning and locking unit and bending device being engaged to said second support body.

BRIEF DESCRIPTION OF THE DRAWINGS

A preferred embodiment of a multi-function pipe bending machine in accordance with the present invention will be now described by way of non-limiting example with reference to the accompanying drawings, in which.

DESCRIPTION OF THE PREFERRED EMBODIMENT

Figure 1:
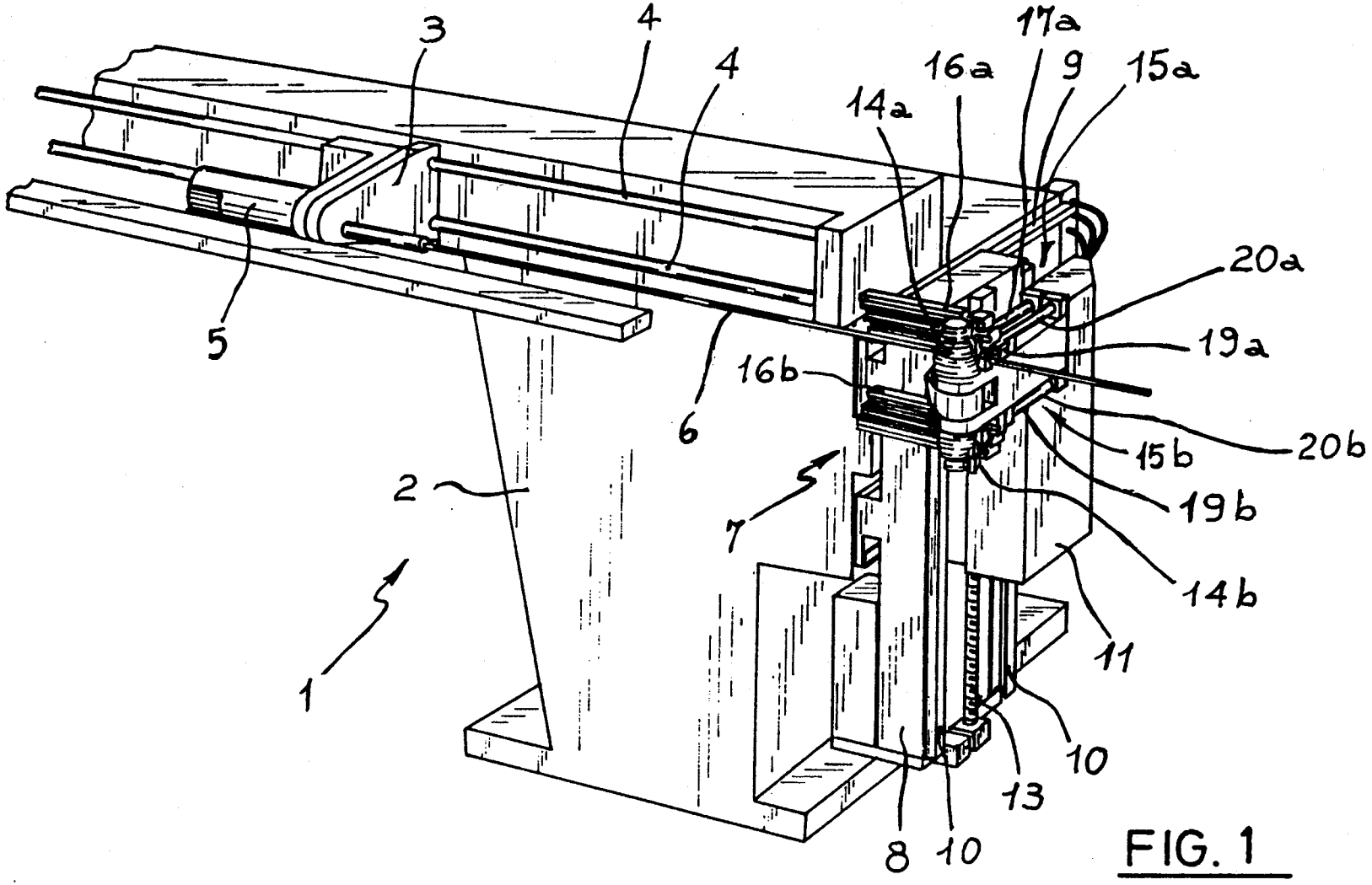
FIG. 1 is a perspective view of a machine in accordance with the invention during an initial work step.

Referring to the drawings, the multi-function pipe bending machine of the invention has been generally identified by reference numeral 1.

It comprises a base structure 2 to which, in a conventional and known manner, a carriage 3 horizontally movable on slide rails 4 is engaged. Provided on said carriage are members 5 (partly shown in the figures) designed to support, rotate and lock a pipe 6 to be bent.

In an original manner, as clearly viewed from the figures, the carriage 3 and the supported pipe 6 are disposed in cantilevered fashion on one side of the base structure 2.

Engaged at the end of the base structure 2 is a bending head 7 comprising a first support body defined by a slide 8 movable on first guides 9 integral to the base structure 2 and oriented horizontally along a first traverse direction.

Slidably engaged to the first slide 8 by means of second guides 10 integral to the first slide itself and oriented vertically along a second traverse direction perpendicular to said first direction, is a second support body defined by a second slide 11.

The first and second slides, 8 and 11, are driven in motion along the respective guides by actuation means for example comprising the electric motors and first and second operating screws, 12 and 13, oriented parallelly to the first guides 9 and second guides 10, respectively.

Two bending dies 14*a* and 14*b* can be positioned on the second slide 11. They are disposed spaced apart from each other in superposed relationship. Therefore an upper die 14*a* and a lower die 14*b* are available and they can be used selectively depending on working requirements.

Figure 2:
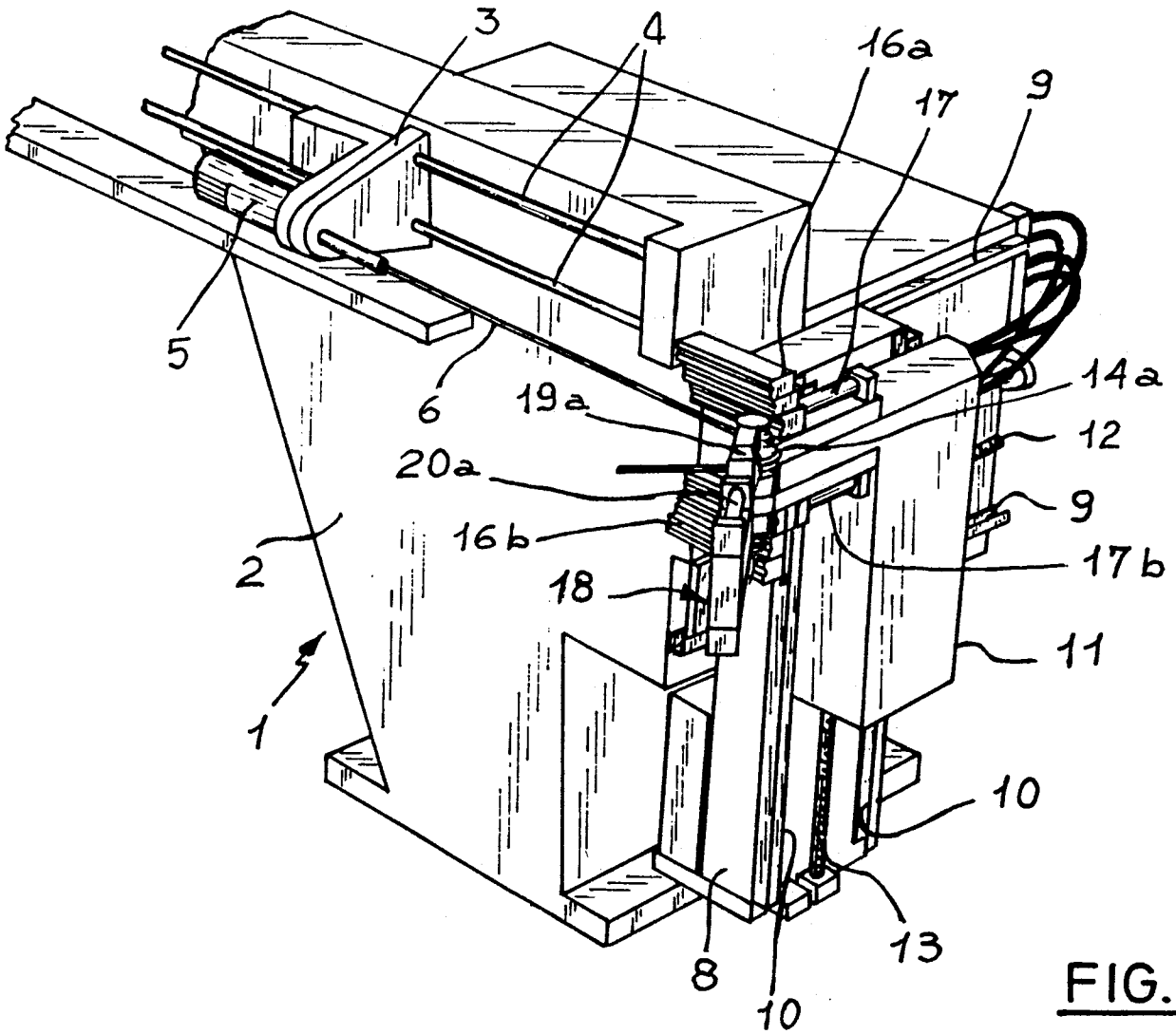
FIG. 2 shows the machine of FIG. 1 while a first bending is being carried out.

An upper and a lower unit 15*a* and 15*b* for positioning and locking the pipe 6 to be bent are provided in the vicinity of said bending dies. They are comprised respectively of an upper jaw 16*a* set in motion by an upper fluid-operated locking cylinder 17*a* and a lower jaw 16*b* set in motion by a lower fluid-operated locking cylinder 17*b* (FIG. 2).

Provision is finally made for a bending arm 18 rotatably movable about an axis coincident with the positioning axis of the bending dies 14*a* and 14*b* and comprising an upper pusher 19*a* and a lower pusher 19*b*, actuated respectively by an upper fluid-operated bending cylinder 20*a* and by a lower fluid-operated bending cylinder 20*b* and active on the pipe 6 against the action of dies 14*a* and 14*b*.

Operation of the multi-function pipe bending machine described above mainly as regards structure, is as follows.

After positioning the pipe 6 on the support and locking means 5, the upper jaw 16*a* for example locks the pipe against the upper die 14*a*. The bending arm 18 by rotating and pressing the pipe 6 by means of the upper pusher 19*a*, carries out one bending according to the intended angle (see FIG. 2).

If for instance a second bending is required in the same pipe at a short distance from the first one and in a plane perpendicular to the plane in which the first bending has been executed thereby involving a downward rotation of the carried out bending, after bringing the bending arm 18 back to its starting position, in accordance with the working cycle it is now necessary to unlock the pipe both by acting on the upper fluid-operated cylinders 17*a* and 20*a*, and by initiating a displacement of the first slide 8 so as to get the pipe 6 free from the die groove.

Figure 3:
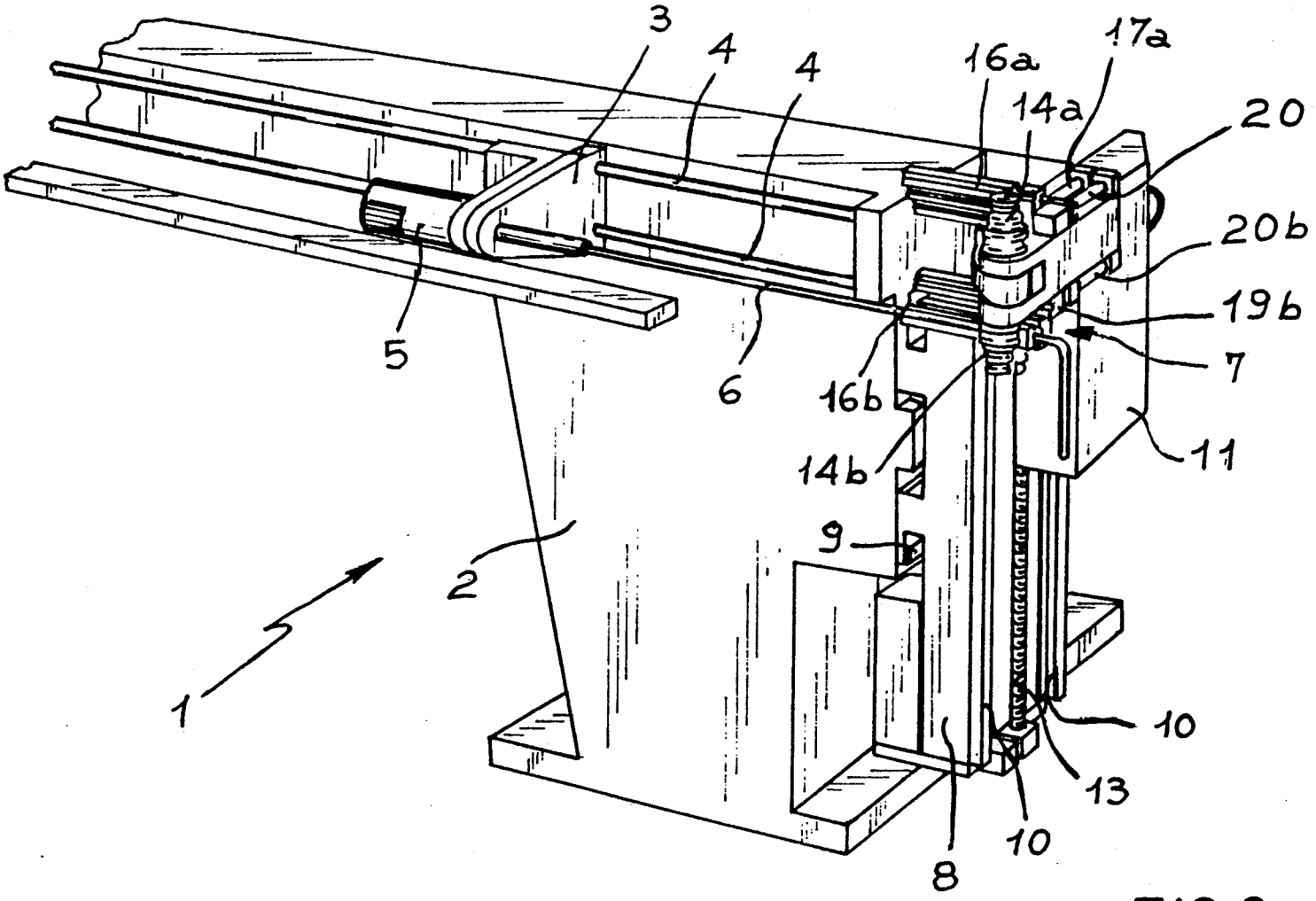
FIG. 3 shows the machine of FIG. 1 as set for the formation of a second bending.

Subsequently, appropriate movements of both the second slide 11 in the vertical direction and the first slide 8 in the horizontal direction combined with the progress of pipe 6 along its axis and its rotation through 90°, allow the lower die 14*b* to be positioned in register with the pipe portion along which a second bending is intended to be formed (see FIG. 3).

In greater detail, for changing from the pipe arrangement shown in FIG. 2 to the pipe arrangement shown in FIG. 3, once the pipe 6 being worked has been unlocked, the second slide 11 is caused to move downwardly, the first slide 8 being subsequently displaced to the right with reference to the drawings.

Afterwards, the second slide 11 is brought upwardly while the first slide 8 is caused to slide to the left so as to bring the bending head in register with the pipe to be bent.

Finally the second slide 11 is slightly moved down again in order to place the lower die 14*b* in an operating position close to the pipe to be bent.

It is noted that in the case shown in the figures the use of the lower die together with the side arrangement in cantilevered fashion of the carriage 3 enables interferences to be avoided between the first pipe length already submitted to bending and some components of the bending head 7.

Should other types of bendings be desired, for example first one bending to the right and then one bending to the left, the movement possibilities offered by slides 8 and 11 allow the dies and bending device 18 to be disengaged from the first location and correctly placed for executing the following bending, while at the same time avoiding interferences with the pipe submitted to bending.

In addition it is pointed out that on pipe bending machines in accordance with the invention dies having different bending diameters can be used. In fact, the displacements of the bending head 7 permit the distance between the center of each die and the longitudinal pipe axis to be properly adjusted. Consequently, for pipes having the same diameter it is possible to use several different dies which are interchangeable with each other so as to achieve bendings of different bending radius.

It is also to be noted that since the pipe bending machine of the invention has gripping members that are made movable in space by slides 8 and 11, it enables the same gripping members to be used as loading and positioning means for placing the pipes onto the supporting and locking elements 5. In this way the use of additional devices such as manipulators or robots for making the pipe supply steps automatic, can be avoided.

Likewise, the crossed movement in the horizontal and vertical directions of slides 8 and 11 can be utilized, when bending is over, for bringing the pipe to a near station, optionally mounted on the pipe bending machine itself, where a machining operation to the pipe ends, such as for example a flaring, tapering, narrowing or enlarging operation, the formation of a collar or the like is carried out. In this way it will be possible to machine the pipe ends while keeping the pipe mounted to the pipe bending machine.

Another opportunity offered by the presence of slides 8 and 11 is that of enabling a high-sensibility detection head, known per se and conventional, to be mounted on the machine. Close to said detection head, when the pipe is still mounted on the pipe bending machine, it is possible to carry out a precision control on the executed bending and the exact geometry of the workpiece.

Modifications and variations may be made to the machine as conceived, all of them falling within the scope of the invention as claimed in the following claims.

What is claimed is:

1. A multi-function pipe bending machine comprising:

a base structure, a first support body slidably engaged to said base structure along a first horizontal axis transverse to a longitudinal axis of a pipe to be bent, first actuation means for displacing said first support body, a second support body slidably engaged to said first body along a second vertical axis transverse to said longitudinal axis of said pipe to be bent perpendicular to said first horizontal axis, second actuation means for displacing said second support body, a carriage for supporting a pipe to be bent, said carriage being disposed in a cantilevered position with respect to the base structure and being horizontally movable along one side of the base structure, an upper and a lower bending die spaced apart from each other in superposed relationship, each of said bending dies comprising a plurality of die members coaxially engaged to said second support, a first and a second unit engaged to said second support body for positioning and locking the pipe to be bent respectively against said first and said second bending die, a bending arm rotatably engaged to said second support coaxially to said bending dies and active on said pipe against the action of one of said upper and lower bending dies.

2. A multi-function pipe bending machine according to claim 1, wherein the bending arm is provided with an upper and a lower pusher rigidly connected to the bending arm for pressing the pipe against the upper and the lower bending die respectively.

3. The pipe bending machine as claimed in claim 1, wherein said first support body is defined by a first slide engaged to first guides integral to said base structure and wherein said second support body is defined by a second slide engaged to second guides integral to said first slide.

4. The machine as claimed in claim 1, wherein said first and second actuation means comprises first and second operating screws active on said first and second support bodies, respectively.

* * * * *